US011148184B2

(12) United States Patent
Chartier et al.

(10) Patent No.: US 11,148,184 B2
(45) Date of Patent: Oct. 19, 2021

(54) SECTIONAL DRAIN CLEANER CABLE SYSTEM FOR CLEAN USE, STORAGE, AND TRANSPORT

(71) Applicant: Ridge Tool Company, Elyria, OH (US)

(72) Inventors: Glen R. Chartier, Avon Lake, OH (US); Robert Skrjanc, Lorain, OH (US); Scott Kruepke, North Royalton, OH (US); Ben Azzam, Avon Lake, OH (US)

(73) Assignee: Ridge Tool Company, Elyria, OH (US)

( * ) Notice: Subject to any disclaimer, the term of this patent is extended or adjusted under 35 U.S.C. 154(b) by 192 days.

(21) Appl. No.: 16/210,068

(22) Filed: Dec. 5, 2018

(65) Prior Publication Data

US 2019/0184438 A1 Jun. 20, 2019

Related U.S. Application Data

(60) Provisional application No. 62/598,548, filed on Dec. 14, 2017.

(51) Int. Cl.

| | |
|---|---|
| ***B21C 47/04*** | (2006.01) |
| ***B65H 75/36*** | (2006.01) |
| ***B21C 47/14*** | (2006.01) |

(52) U.S. Cl.

CPC ..... *B21C 47/04* (2013.01); *B21C 47/045* (2013.01); *B21C 47/143* (2013.01)

(58) Field of Classification Search

CPC ..... B21C 47/04; B21C 47/045; B21C 47/143; B21C 47/10; B21C 47/12; B21C 47/14; B21C 47/34; B21C 47/3433; B65H 75/364; B65H 75/40; B65H 75/4471; B65H 2701/33; B08B 9/045; B08B 9/0436; E03C 1/302; E03F 9/005

See application file for complete search history.

(56) References Cited

U.S. PATENT DOCUMENTS

| | | | | |
|---|---|---|---|---|
| 2,685,097 | A * | 8/1954 | Allen | B65H 75/364 15/104.33 |
| 2,730,740 | A * | 1/1956 | O'Brien | E03F 9/005 15/104.33 |
| 3,007,186 | A * | 11/1961 | Olsson | E03F 9/005 15/104.33 |
| 3,048,870 | A * | 8/1962 | Criscuolo | E03F 9/005 15/104.33 |
| 3,162,878 | A * | 12/1964 | Agostino | E03F 9/005 15/104.33 |
| 3,268,937 | A * | 8/1966 | Bollinger | E03F 9/005 15/104.33 |

(Continued)

FOREIGN PATENT DOCUMENTS

| | | |
|---|---|---|
| EP | 1818114 | 8/2007 |

OTHER PUBLICATIONS

Operator's Manual for K-7500 Drum Machine (63 pages, Feb. 1998).

(Continued)

*Primary Examiner* — Michael E Gallion

(74) *Attorney, Agent, or Firm* — Mark E. Bandy; Rankin Hill & Clark, LLP

(57) ABSTRACT

Various storage containers are described for retaining drain cleaning cables. Storage systems utilizing the containers with a cable guide assembly are further described. Also described are methods of using the containers and systems.

37 Claims, 10 Drawing Sheets

(56) References Cited

U.S. PATENT DOCUMENTS 3,298,051 A * 1/1967 Ratliff ..... E03F 9/005 15/104.33
3,605,158 A * 9/1971 Russell ..... E03F 9/005 15/104.33
3,691,583 A * 9/1972 Silverman ..... E03F 9/005 15/104.33
4,364,139 A * 12/1982 Babb ..... E03F 9/005 15/104.33
4,570,281 A * 2/1986 Boelens ..... B08B 9/045 15/104.33
4,914,775 A * 4/1990 Kirk ..... E03F 9/005 15/104.33
4,916,772 A * 4/1990 Russell ..... B08B 9/045 15/104.33
4,956,889 A * 9/1990 Kirk ..... E03F 9/005 15/104.33
5,193,242 A * 3/1993 Irwin ..... B08B 9/045 15/104.31
6,009,588 A * 1/2000 Rutkowski ..... B08B 9/045 15/104.33
7,222,383 B2 * 5/2007 Hale ..... B08B 9/045 15/104.31
7,676,879 B1 * 3/2010 Rutenberg ..... B08B 9/045 15/104.33
7,935,192 B2 * 5/2011 Silverman ..... B08B 9/045 134/22.11
8,931,131 B1 * 1/2015 Feduke ..... E03F 9/002 15/104.33
9,234,342 B1 * 1/2016 Beesley ..... E03C 1/302
9,368,303 B2 * 6/2016 Tracey ..... H01H 37/72
10,465,372 B2 * 11/2019 Bowles ..... E03F 9/005
10,626,593 B2 * 4/2020 Puzio ..... B08B 9/0436
10,646,906 B2 * 5/2020 Cole ..... E03F 9/005
10,722,928 B2 * 7/2020 Kehoe ..... E03F 9/005
10,841,465 B1 * 11/2020 Dvorsky ..... H04N 5/2257
10,858,022 B2 * 12/2020 Chartier ..... B62B 1/264
2005/0193509 A1 * 9/2005 Rutkowski ..... B65H 75/4471 15/104.33
2008/0098544 A1 * 5/2008 Rutkowski ..... B08B 9/045 15/104.33
2009/0038093 A1 * 2/2009 Irwin ..... B08B 9/0436 15/104.095
2009/0211044 A1 * 8/2009 Hale ..... E03F 9/005 15/104.33
2010/0017981 A1 * 1/2010 Hamm ..... B08B 9/045 15/104.33
2010/0050350 A1 * 3/2010 Babb ..... B65H 75/364 15/104.33
2010/0139696 A1 * 6/2010 Silverman ..... B08B 9/045 134/22.11
2018/0016776 A1 * 1/2018 Stoneback ..... E03F 9/005
2020/0409009 A1 * 12/2020 Marcouiller ..... B65H 75/14

OTHER PUBLICATIONS

Parts List for K-7500 Drum Machine (4 pages, Jun. 7, 2010).
Operator's Manual for K-750 Drum Machine (67 pages, Oct. 2003).
Parts List for K-750 Drum Machine (4 pages, 2014) : Earliest identified publication Jun. 7, 2010.
Operator's Manual for SeeSnake Standard and Mini Pipe Inspection Systems (22 pages, Jun. 1997).
Parts List for SeeSnake Standard and Mini Pipe Inspection Systems (9 pages, Jun. 7, 2010).
International Search Report and Written Opinion; Application PCT/US2018/063966; dated Feb. 8, 2019; 13 pages.

* cited by examiner

SECTIONAL DRAIN CLEANER CABLE SYSTEM FOR CLEAN USE, STORAGE, AND TRANSPORT

CROSS REFERENCES TO RELATED APPLICATIONS

This application claims priority from U.S. provisional application Ser. No. 62/598,548 filed on Dec. 14, 2017.

FIELD

The present subject matter relates to drain cleaning equipment and particularly sectional drain cleaning equipment and sectional drain cleaning cables.

BACKGROUND

In current sectional drain cleaning, multiple cable sections of drain cleaning cable are typically transported from an operator's van/truck to the drain using an open wire basket. FIG. 1 illustrates an empty wire basket 2 used for storing drain cleaning cable. FIG. 2 shows the wire basket 2 of FIG. 1 retaining a wound drain cleaning cable 5.

When a drain cleaning professional sets up the working area around a drain, a section of cable 5 must be retrieved from the wire basket 2 and decoupled from the remainder of cable within the basket. This cable to be used for drain cleaning is pulled out of a circular opening 6 at the center of the wire basket 2. However, due to the free state of the cable being in a generally straight linear form, the cable tends to spring out of the wire basket unexpectedly.

Because the wire basket is mostly open, any debris or drain blockage remnants, in addition to fluid, that return from the drain when the cable is retrieved are exposed to and often contaminate the jobsite environment. This is undesirable because in many applications the jobsite is a clean area of someone's home, business, or the like. The user must take great care to protect their surroundings from this messy situation.

Accordingly, in view of these and other concerns, a need exists for assemblies and related methods which overcome these concerns.

SUMMARY

The difficulties and drawbacks associated with previous approaches are addressed in the present subject matter as follows.

In one aspect, the present subject matter provides a storage drum for drain cleaning cables comprising a first face defining at least one opening. The storage drum also comprises an oppositely directed second face. The second face includes an inwardly extending portion defining a centrally located aperture. The storage drum also comprises a generally circumferential outer wall extending between the first face and the second face. The centrally located aperture is accessible from the first face, via the opening defined in the first face.

In another aspect, the present subject matter provides a storage system for drain cleaning cables. The system comprises a storage drum including (i) a first face defining at least one opening, (ii) an oppositely directed second face, the second face including an inwardly extending portion defining a centrally located aperture, and (iii) a generally circumferential outer wall extending between the first face and the second face. The system also comprises a base including a planar member defining a top face and an oppositely directed bottom face, and a post extending from the top face of the planar member. The drum is positioned adjacent the base such that the post extends at least partially through the centrally located aperture. The system also comprises a cable guide assembly rotatably supported by the post.

In yet another aspect, the present subject matter provides a storage system for drain cleaning cables. The system comprises a storage drum including (i) a first face defining at least one opening, (ii) an oppositely directed second face, the second face including an inwardly extending portion defining a centrally located aperture, and (iii) a generally circumferential outer wall extending between the first face and the second face wherein the second face includes a cylindrical member extending from the aperture. The cylindrical member extends along an axis that is perpendicular to the plane of the first face. The system also comprises a cable guide assembly rotatably supported by the cylindrical member.

In still another aspect, the present subject matter provides a storage system for drain cleaning cables. The system comprises a mobile cart including a frame, a base, and at least one wheel. The system also comprises a storage drum secured to the cart. The drum includes (i) a first face defining at least one opening, (ii) an oppositely directed second face, the second face including an inwardly extending portion defining a centrally located aperture, and (iii) a generally circumferential outer wall extending between the first face and the second face wherein the second face includes a cylindrical member extending from the aperture. The cylindrical member extends along an axis that is perpendicular to the plane of the first face. The system also comprises a cable guide assembly rotatably supported by the cylindrical member.

In yet another aspect, the present subject matter provides a method of storing a drain cleaning cable. The method comprises providing a storage system for drain cleaning cables, the system including a storage drum including (i) a first face defining at least one opening, (ii) an oppositely directed second face, the second face including an inwardly extending portion defining a centrally located aperture, and (iii) a generally circumferential outer wall extending between the first face and the second face. The system also includes a base including a planar member defining a top face and an oppositely directed bottom face, and a post extending from the top face of the planar member, and a cable guide assembly rotatably supported by the post. The method also comprises inserting an end of the drain cleaning cable to be stored, in the cable guide assembly and into the storage drum. The method further comprises pushing the drain cleaning cable through the cable guide assembly and into the storage drum whereby at least one of the storage drum and the cable guide assembly rotates about the post, such that the drain cleaning cable is formed into a coiled arrangement within the drum.

In another aspect, the present subject matter provides a method of selectively dispensing a drain cleaning cable from a storage drum. The method comprises providing a storage system for drain cleaning cables. The system includes a storage drum including (i) a first face defining at least one opening, (ii) an oppositely directed second face, the second face including an inwardly extending portion defining a centrally located aperture, and (iii) a generally circumferential outer wall extending between the first face and the second face. The system also includes a base including a planar member defining a top face and an oppositely directed bottom face, and a post extending from the top face of the planar member, and a cable guide assembly rotatably supported by the post. The method also comprises inserting an end of the drain cleaning cable to be dispensed, in the cable guide assembly and out of the storage drum. The method further comprises pulling the drain cleaning cable through the cable guide assembly and out of the storage drum whereby at least one of the storage drum and the cable guide assembly rotates about the post, such that the drain cleaning cable is selectively dispensed from the drum.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
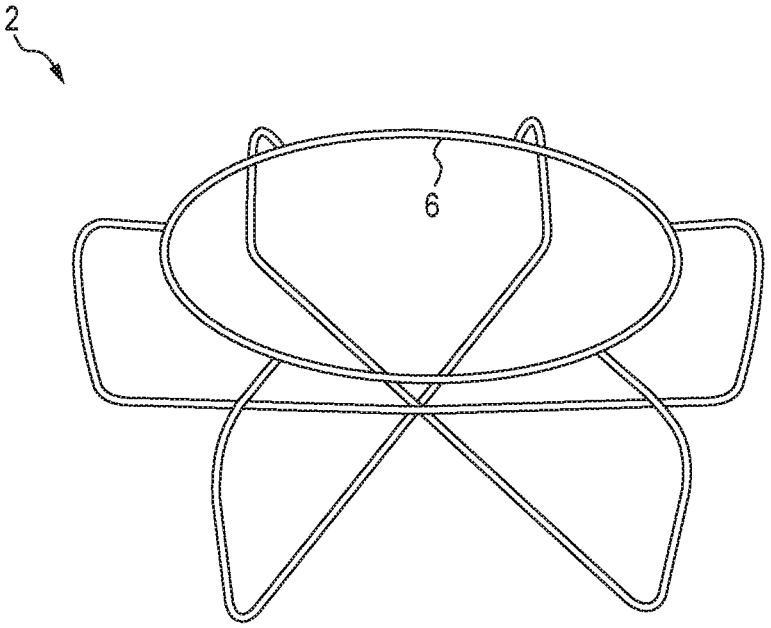
FIG. 1 is a perspective view of a typical empty wire cable basket.
Figure 2:
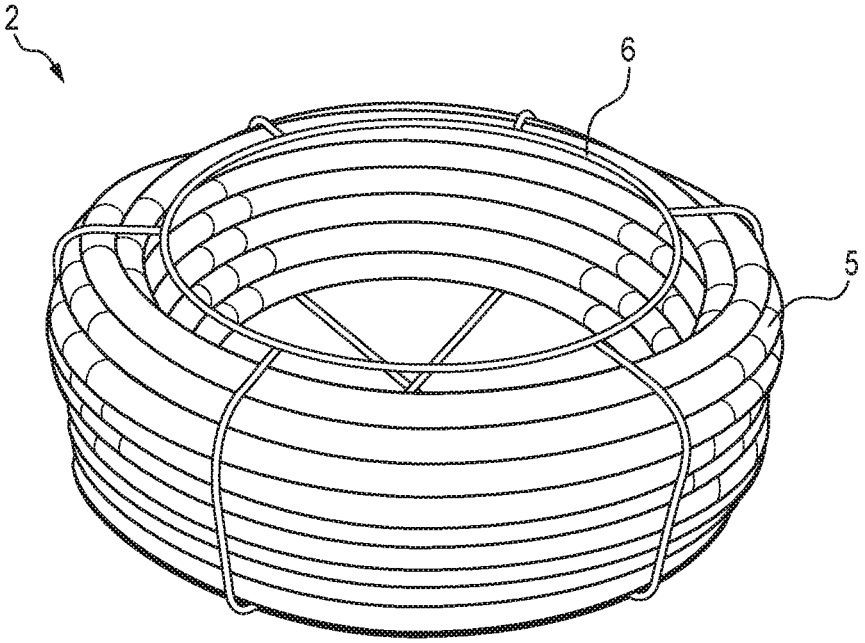
FIG. 2 is a perspective view of the cable basket of FIG. 1 containing drain cleaning cable coiled within the basket.
Figure 3:
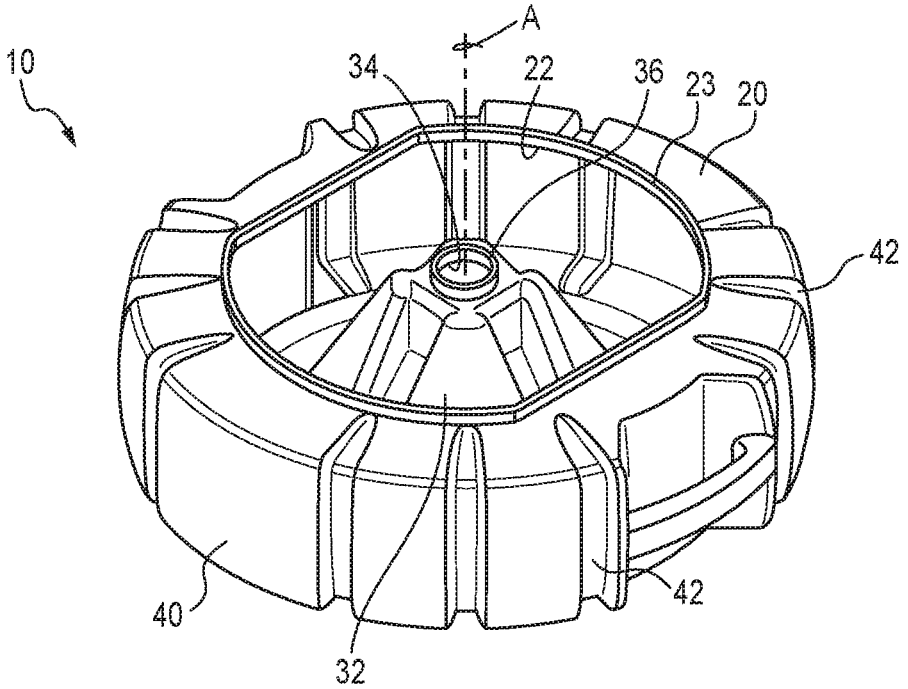
FIG. 3 is a perspective front view of an embodiment of an enclosed storage drum for sectional drain cleaning cable in accordance with the present subject matter.
Figure 4:
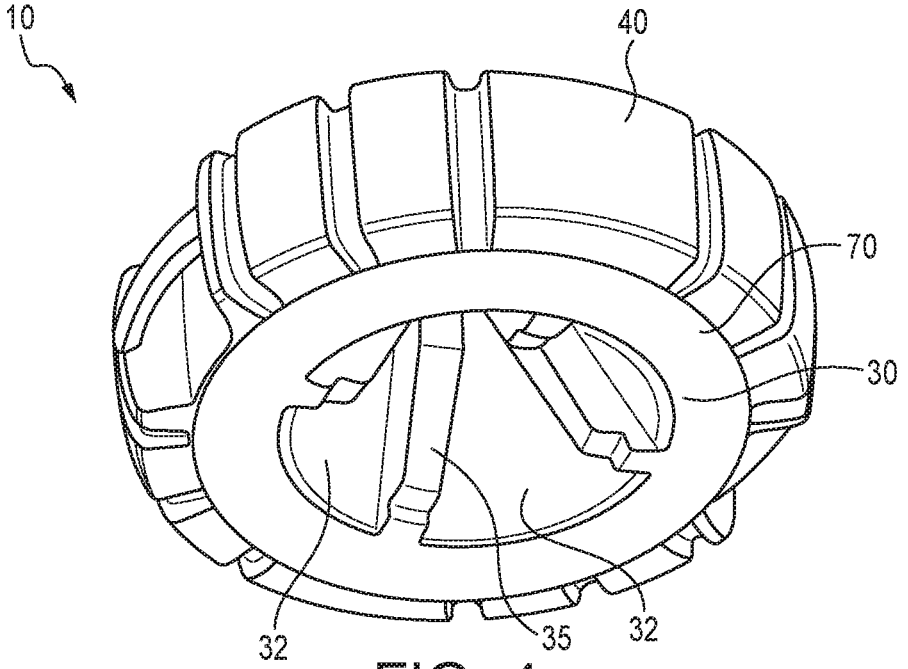
FIG. 4 is a perspective rear view of the drum of FIG. 3.

The present subject matter relates to sectional drain cleaning cable use, storage, and transport. The present subject matter could apply to drain cable supplied or available under the RIDGID designation, or other manufacturers of drain cleaning cable and also applies to any cable size, for example, diameter, length, and/or other variation of this product type.

By utilizing the present subject matter storage drums and/or systems; easier, controlled insertion and removal of drain cleaning cable from a storage container is achieved. The present subject matter results in low effort requirements for use. Further, the present subject matter results in cleaner jobsites in drain cleaning applications.

The present subject matter provides an enclosed storage container or drum adapted for sectional drain cables and an apparatus that allows easy insertion or removal of the drain cleaning cable from the drum through relative motion between the drum and a cable guide assembly.

The present subject matter features an enclosed or substantially enclosed storage drum for sectional drain cables. This enclosed storage drum holds the drain cleaning cable against an inner span of the interior of the drum which is typically the largest diameter of the interior region of the drum. The storage drum prevents fluid or returned debris from the drain from exiting to the jobsite surroundings, thereby improving the cleanliness of the work environment. This cleanliness, or lack thereof, is a common complaint against sectional drain cleaning use today.

Referring to FIGS. 3-6, an embodiment of a storage drum 10 in accordance with the present subject matter is shown. The storage drum 10 comprises a first face 20 defining at least one opening 22, an oppositely directed second face 30, and a generally circumferential outer wall 40 extending between the first face 20 and the second face 30. The first face 20 may include a raised lip 23 that defines the opening 22. The raised lip 23 is described in greater detail herein. The second face 30 includes an inwardly extending portion 32 defining a centrally located aperture 34. The aperture 34 is accessible from the first face 20 via the opening 22. The inwardly extending portion 32 of the second face 30 is typically conical in shape and extends between the aperture 34 and a remaining portion of the second face 30 at an angle within a range of from 15° to 60°, more particularly from 20° to 45°, and in certain versions 30°. The inwardly extending portion 32 may include one or more strengthening ribs 35. For versions using the conical portion 32, the remaining portion of the second face 30 is annular in shape. The generally circumferential outer wall 40 typically includes one or more recesses 42 and/or ridges for promoting strength and rigidity of the drum 10.

In many versions of the storage drum 10, the second face 30 and more particularly the inwardly extending portion 32, includes a cylindrical member 36 extending from or defining the aperture 34. The member 36 includes a circumferential wall. The member 36 generally extends along an axis that is perpendicular to the plane of the first face 20 and/or second face 30. This axis is shown in the referenced figures as axis A. Typically, the circumferential outer wall 40 extends about an axis that is common, i.e., coextensive and collinear, with axis A. Thus, the axis of the cylindrical member 36 is collinear with a center axis about which the generally circumferential outer wall 40 extends.

Another feature of the present subject matter is a dedicated drain area with one or more selectively removable plug(s) to control the release of returned drain fluid that accumulates in the storage container. This feature allows the user to transport the storage drum to an appropriate area prior to releasing the dirty run-off. The term "run-off" as used herein refers to dirt, debris, and/or particulates typically dispersed and carried in a liquid which is often water. The liquid may also include non-aqueous liquids. The term "run-off" also includes liquid free of dirt, debris, and/or particulates. Such liquid is typically water but can include non-aqueous liquids such as oils, organic solvents, and/or petroleum materials for example.

Figure 6:
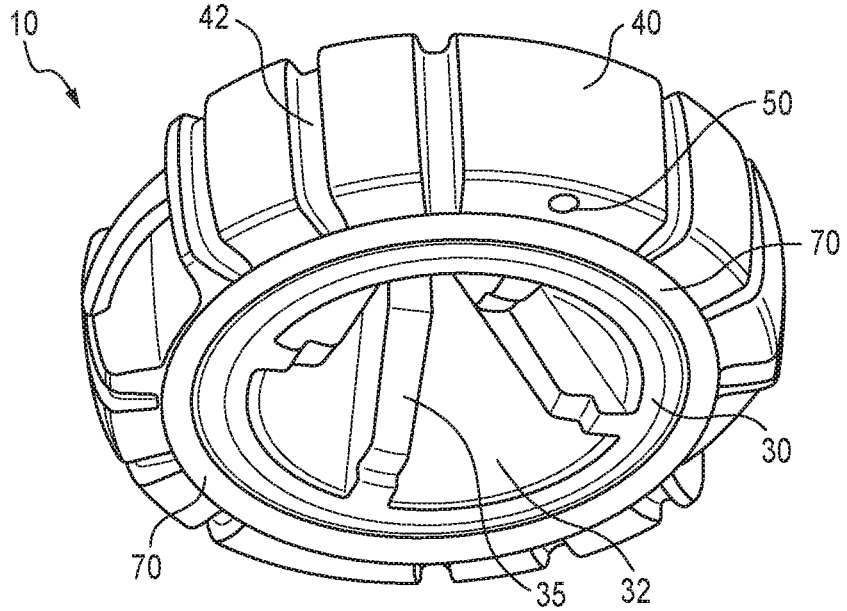
FIG. 6 is a perspective rear view of the drum of FIGS. 3 and 4 with additional features.
Figure 7:
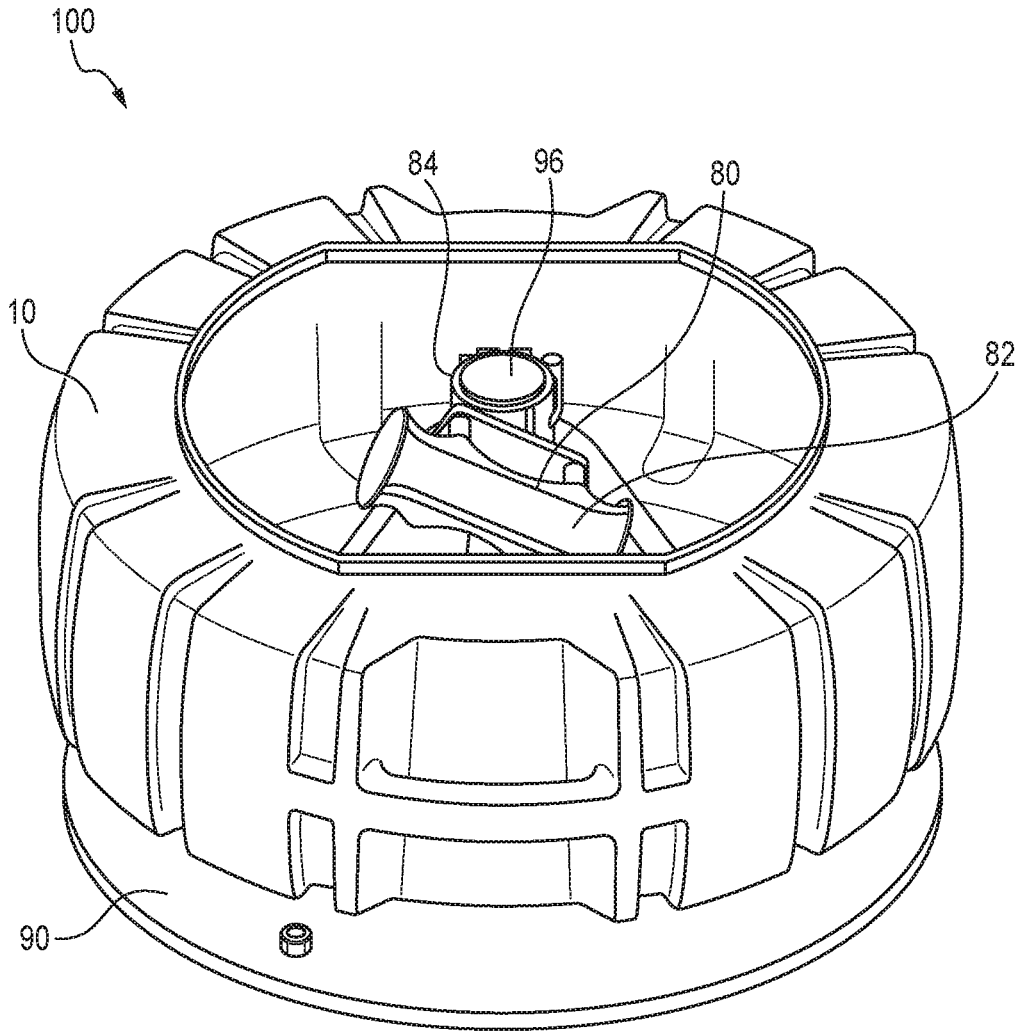
FIG. 7 is a front perspective view of the drum of FIGS. 3 and 4 in association with an embodiment of a storage system in accordance with the present subject matter.

As best illustrated in FIG. 6, the storage drum 10 may optionally include one or more selectively removable plugs 50 in either or both of the first face 20 and the second face 30. For example, one or more plugs 50 can be provided in the first face 20, one or more plugs 50 can be provided in the second face 30, and/or one or more plugs 50 can be provided in both the first and second faces 20, 30. In the version depicted in the referenced figure, a selectively removable plug 50 is provided in the second face 30 at a location between the inwardly extending portion 32 and the circumferential outer wall 40. As will be understood, the plug 50 typically includes a plug component or similar member that a user removes or disengages from an opening or port in the face that enables access to an interior region of the storage drum 10. The plug can be inserted or engaged in the opening or port to preclude access to the interior region.

Additionally, in certain versions the storage container can feature grab handles for carrying or loading the drain cables retained in the storage container to ease the effort required by the operator.

Figure 5:
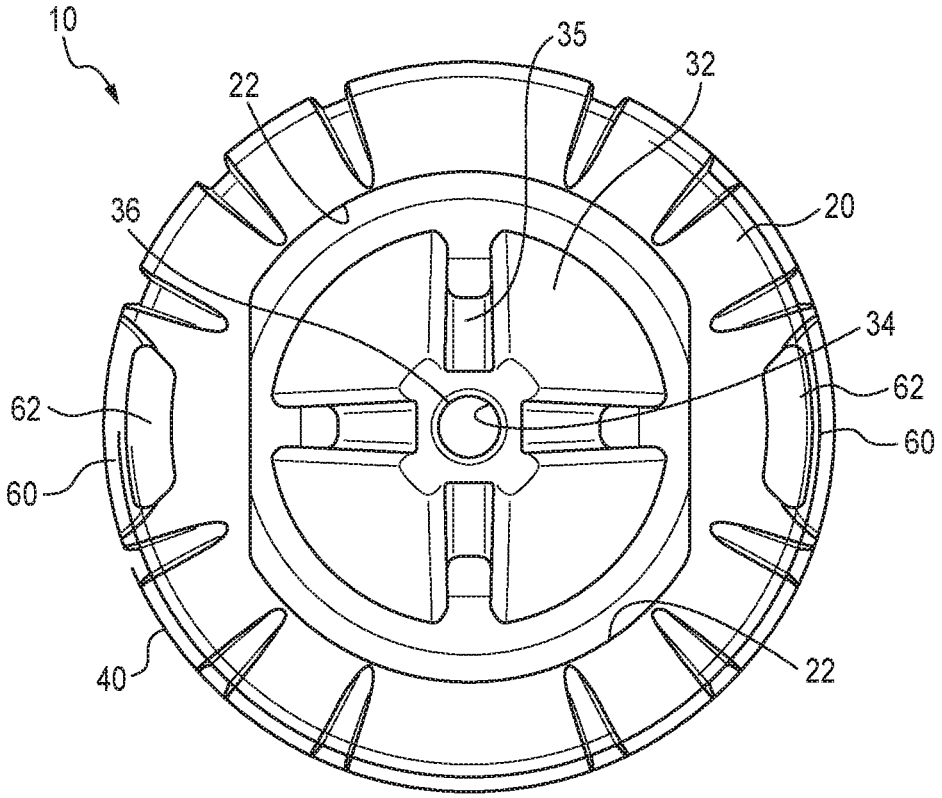
FIG. 5 is a front view of the drum of FIGS. 3 and 4.

Referring to FIG. 5, the storage drum 10 may optionally comprise one or more handles 60 for grabbing gripping, and/or handling the drum. Typically, the handle(s) 60 are provided along the circumferential outer wall 40 rather than one or both of the faces 20, 30. Thus, the handle(s) 60 do not interfere when the storage drum 10 is positioned on either of its faces 20, 30. However, the present subject matter includes locating or providing one or more handles 60 adjacent or alongside the first face 20 and/or the second face 30. In many versions of the drum 10, the drum comprises two handles 60, located on opposite regions of the circumferential outer wall 40 and located 180° apart from each other, as shown in FIG. 5. However, it will be understood that the present subject matter includes a wide range of locations and configurations for the handles 60 and is not limited to the version depicted in FIG. 5. Also, in particular versions, the handles 60 have an arcuate shape such that an outermost region of the handle(s) exhibits a curvature which is similar or the same as that of the outer wall 40. Thus, an opening 62 associated with a handle 60 is radially recessed, and the handle 60 is configured to extend in an arcuate manner and along the circumference of the outer wall 40.

Yet another feature of the present subject matter is a stacking provision. This stacking feature provides easy and efficient storage of drain cleaning cable in the compact work vehicles of drain cleaning professionals. The feature also limits movement of the storage drum relative to another drum it rests upon during transport when the drums are positioned in a face to face arrangement.

Referring to FIG. 6, the storage drum 10 may optionally comprise one or more stacking provisions 70. In the version shown in FIG. 6, the stacking provision 70 is in the form of a circular ridge extending outwardly from the second face 30 of the drum 10. It will be understood that the present subject matter is not limited to this representative form of stacking provision 70, and could include a wide array of other forms and configurations for the stacking provision 70. In certain versions, the stacking provision 70 is provided on the same face as is located the selectively removable plug 50. For versions of the storage drum 10 comprising a stacking provision 70 in the form of an outwardly extending circular ridge concentrically located on the second face 30 of the drum 10, it may also be preferred to provide a mating feature on a first face 20 of the drum 10 and other drums 10 to engage the circular ridge. Upon stacking of the drums, the mating feature on the first face 20 of a drum can engage the circular ridge on the second face 30 of an adjacent drum in the stack. Such engagement serves to align the drums and hold the drums in the stacked arrangement. The mating feature can be provided in a range of configurations. In the version shown in the referenced figures, the mating feature is in the form of the raised lip 23 shown in FIG. 3. In this particular version, the raised lip 23 of one drum and the circular ridge stacking provision 70 of another drum stacked together, are configured to engage each other.

In the various embodiments described herein, the first and second faces 20, 30 and the outer wall 40 are in the form of continuous members and free of openings (other than the opening or port associated with the plug 50) through which liquid or debris could pass. Thus, the continuous members are significantly different in structure and function than wire forms or open frame configurations as may be known in the art. The first and second faces and outer wall, and other components of the storage drums can be formed from a wide array of materials such as metals, plastics, and composite materials. Moldable plastics are preferred for many embodiments. In particular embodiments, rotationally moldable plastics including high density polyethylene (HDPE) can be used.

The present subject matter further features an apparatus or system to allow easy insertion or removal of drain cleaning cable from the storage drum through relative motion between the drum and a cable guide assembly. In this version, a low friction bearing allows the storage drum to rotate relative to a stationary base. The cable guide assembly is fixed in position onto the stationary base.

Figure 8A:
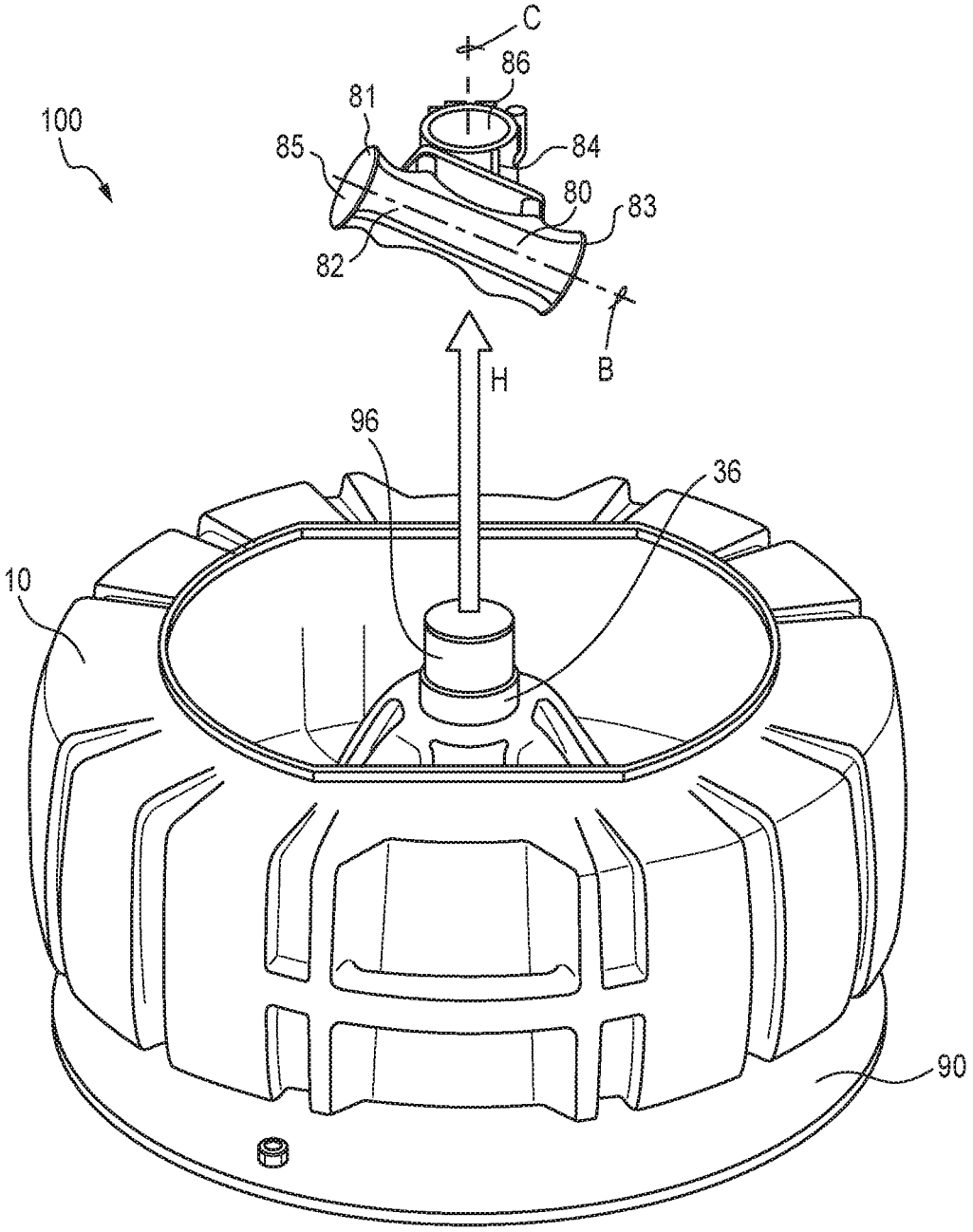
FIGS. 8A-8D illustrate a series of operations for changing storage drums in the system depicted in FIG. 7.
Figure 8B:
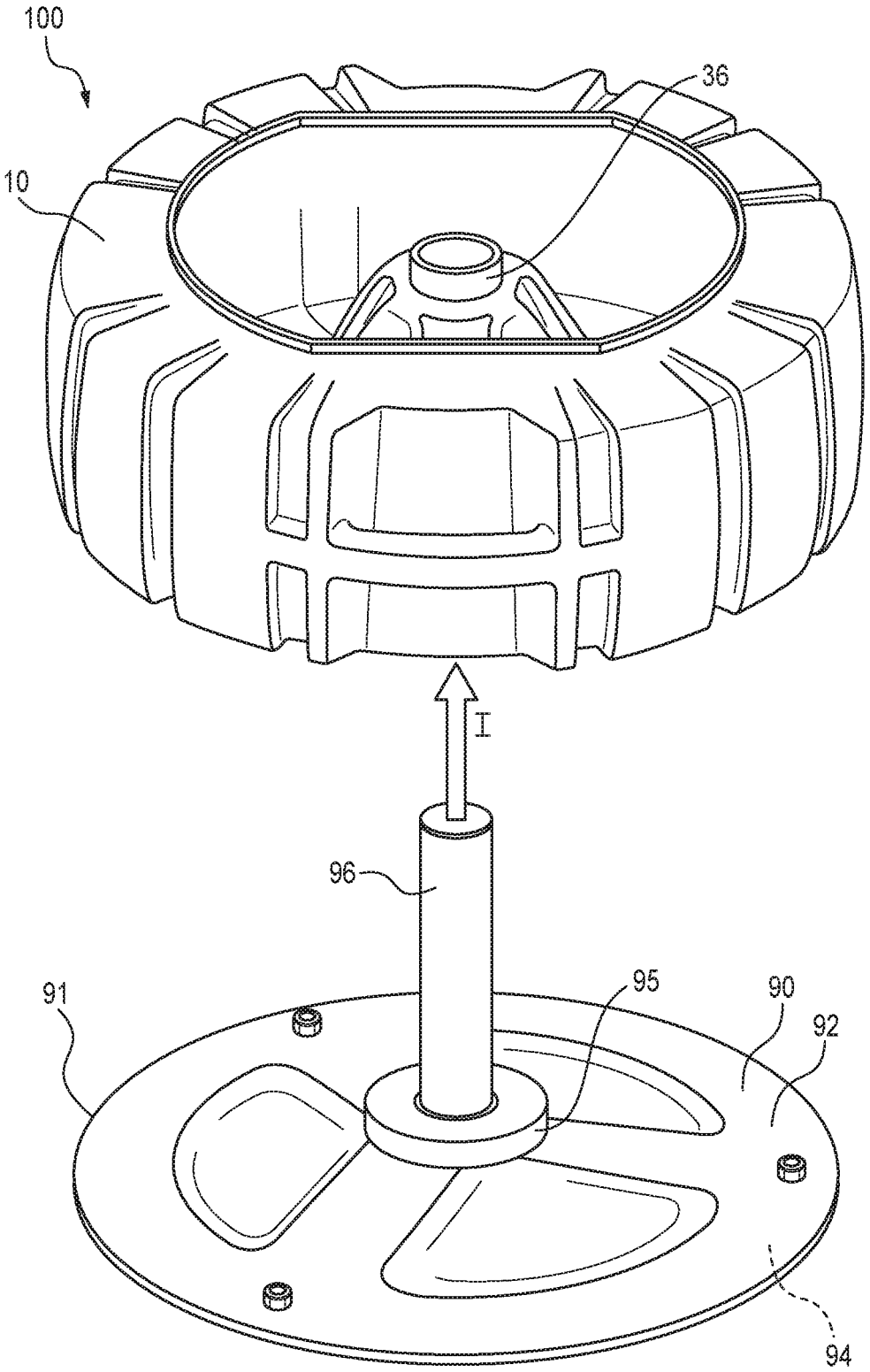
Figure 8C:
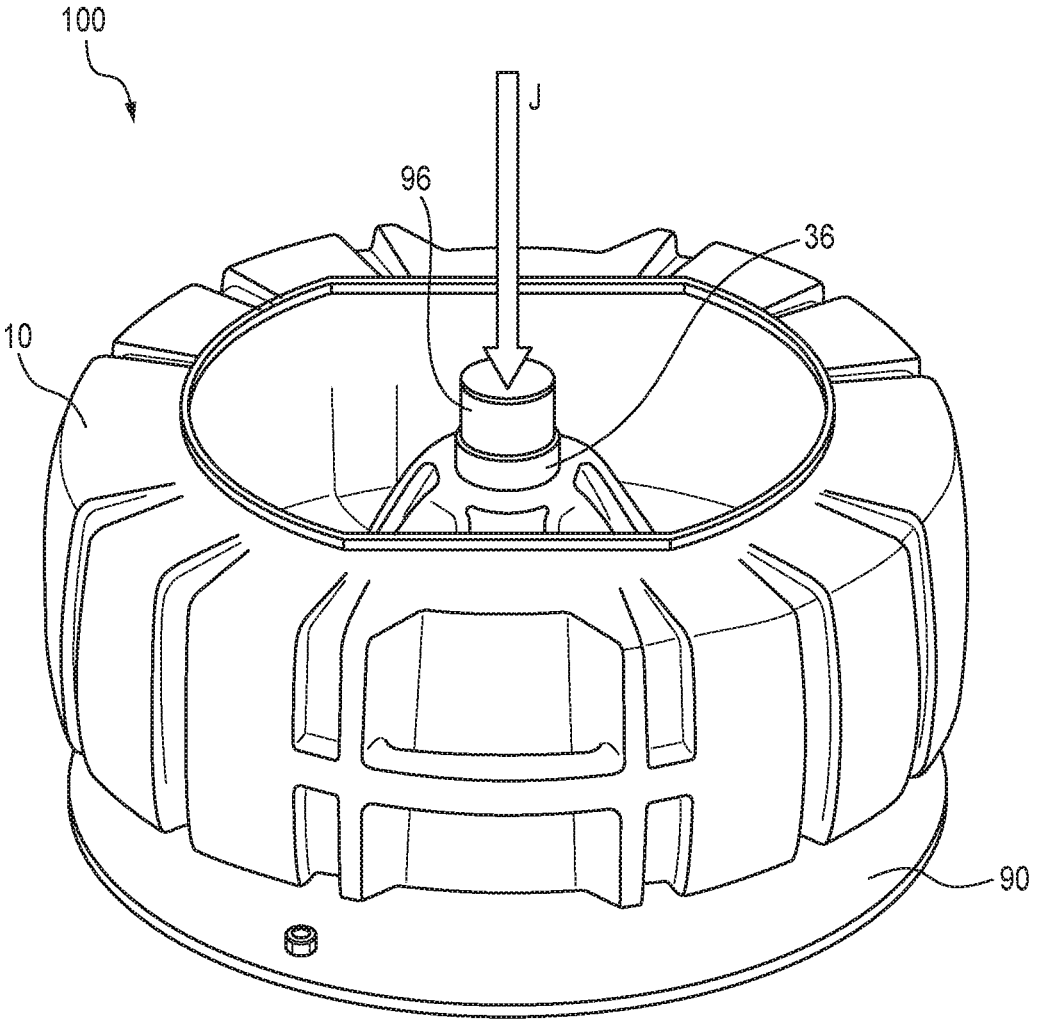
Figure 8D:
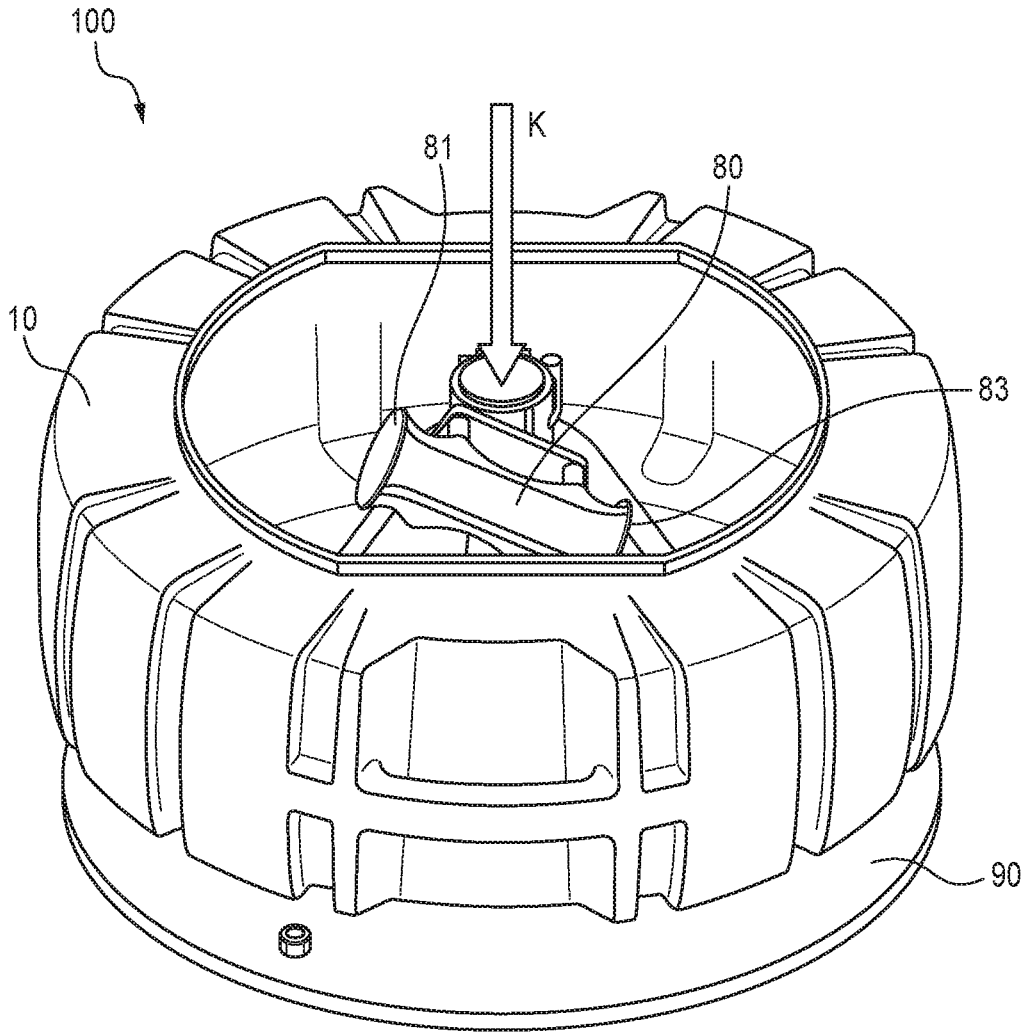

Referring to FIGS. 7 and 8A-8D, the present subject matter provides a storage system 100 comprising the previously noted storage drum 10, a cable guide assembly 80, and a base 90. As best illustrated in FIG. 8B, the base 90 includes a planar member 91 that defines a top face 92 and an oppositely directed bottom face 94. Typically, the planar member 91 is positioned on the ground or floor, with the bottom face 94 directed toward the ground or floor. The base 90 also includes a post 96 extending from the top face 92 of the planar member 91. The base can also include a bearing/bushing 95 mounted on the base 90. The bearing/bushing 95 can take a variety of different forms and configurations. In certain versions the bearing/bushing 95 is in the form of a roller bearing. In yet other versions, a low friction member could be used instead of a bearing or mechanical assembly. Non-limiting examples of low friction materials include polyoxymethylene (POM), a material known in the art as "acetal," or ultra-high molecular weight polyethylene (UHMWPE), or like material(s). Use of the bearing/bushing 95 promotes rotation of the drum 10 relative to the post 96 and base 90 upon removal or insertion of cable via the cable guide assembly 81. In certain versions of the base 90, a circular member (not shown) such as in the form of a steel disc can be affixed to the underside of the drum 10 to close off the inwardly extending portion 32. This circular member provides a smooth surface for contacting the bearing/bushing 95 during rotation. The drum 10 is positioned on or adjacent the base 90 such that the post 96 extends at least partially through the aperture 34. As best shown in FIG. 8A, the cable guide assembly 80 includes a cable sleeve 82 affixed to a circumferential support 84. The cable sleeve 82 defines a first elevated end 81, a second lowered end 83, and a cable passage 85 extending between the ends 81 and 83. The references "elevated" and "lowered" refer to the position of the ends 81, 83 of the cable sleeve 82 upon positioning the cable guide assembly 80 in a use position shown in FIGS. 7 and 8D. In that use position, the first end 81 is directed out of or elevated with respect to the interior of the storage drum 10 and the second end 83 is positioned within or lowered with respect to the interior of the storage drum 10. Thus, it will be understood that these terms have no association or connotation with respect to the orientation of the drum 10. The circumferential support 84 also defines a passage 86 extending through the support 84. The passage 86 is sized and shaped to receive the post 96 of the base 90. In many versions of the cable guide assembly 80, the cable sleeve 82 and particularly a longitudinal axis B of the cable passage 85, is oriented at an angle within a range of from 45° to 85° with respect to a longitudinal axis C of the passage 86 of the support 84. In many versions, the cable sleeve 82 is oriented at an angle within a range of from 55° to 75° and more particularly about 65° with respect to the passage 86.

However, it will be understood that the present subject matter includes other configurations and orientations of the cable sleeve 82, and is not limited to the particular embodiment described herein and depicted in the referenced figures.

As a user pushes drain cleaning cable through the cable guide assembly, the guide assembly directs the cable towards an orientation tangential to the inside wall of the storage drum. Continued pushing of the cable through the guide assembly will cause the cable to contact this wall and initiate drum rotation. As the drum rotates while the user continues to feed cable into the storage drum via the guide assembly, cable will line the wall and coil into the drum. Often, the cable will adopt an aligned and wound configuration within the storage drum.

Removing drain cleaning cable from the storage drum follows an opposite process. As the user pulls cable from the guide assembly, the storage drum easily rotates to allow removal. As the cable exits the guide assembly, the cable returns to its linear free state or orientation, ready to be used for drain cleaning. When the storage drum is emptied of drain cleaning cable, attachment and preferably a tool-less attachment of the guide assembly to the stationary base allows for quick and easy removal of the guide assembly and, subsequently, the empty storage drum. A new, fully loaded storage drum can then be placed on the base and the guide assembly reinstalled for continued drain cleaning operation.

Referring further to FIGS. 8A-8D this process of changing drums is shown in greater detail. After a user has withdrawn, i.e., pulled, all drain cleaning cable from the drum 10 thus emptying the drum 10, the user removes the cable guide assembly 80 from the post 96 of the base 90. Typically, such removal is performed by pulling the cable guide assembly 80 from the post 96 in the direction of arrow H in FIG. 8A. Preferably, the cable guide assembly 80 can be rotatably engaged and disengaged from the post 96 without the use of tools. The cable guide assembly 80 can be configured to clamp or be releasably affixed onto the post 96 and is held in position relative to the post 96 while the drum 10 spins. The user then removes the empty drum 10 from the post 96 and base 90 by displacing the drum 10 from the post 96 in the direction of arrow I in FIG. 8B. Another drum 10 containing drain cleaning cable (not shown) is then positioned and placed onto the base 90 by urging and inserting the post 96 into and through the member 36 of the drum 10. In this operation, the drum 10 is moved in the direction of arrow J shown in FIG. 8C. Next, the cable guide assembly 80 is positioned onto the exposed portion of the post 96 by moving guide assembly 80 in the direction of arrow K in FIG. 8D.

As previously described, the present subject matter can include a stationary base at a fixed position, with the drum rotating during use. Another variant also encompassed by the present subject matter is a stationary storage drum in which a cable guide assembly rotates. In this version, the operation is as previously described. As the cable is pushed into the drum through the guide assembly, the cable is oriented towards an orientation tangential to the wall of the storage drum and is typically arranged in a coil. As the cable is continued to be inserted, the cable guide assembly will rotate, laying the cable around the interior of the drum as the guide assembly turns. Retrieval of the cable will turn the guide assembly as the cable is easily removed by hand at the end of the guide assembly. When emptied, the entire guide assembly can be moved to a new, fully loaded storage drum for ongoing cable use.

Figure 9:
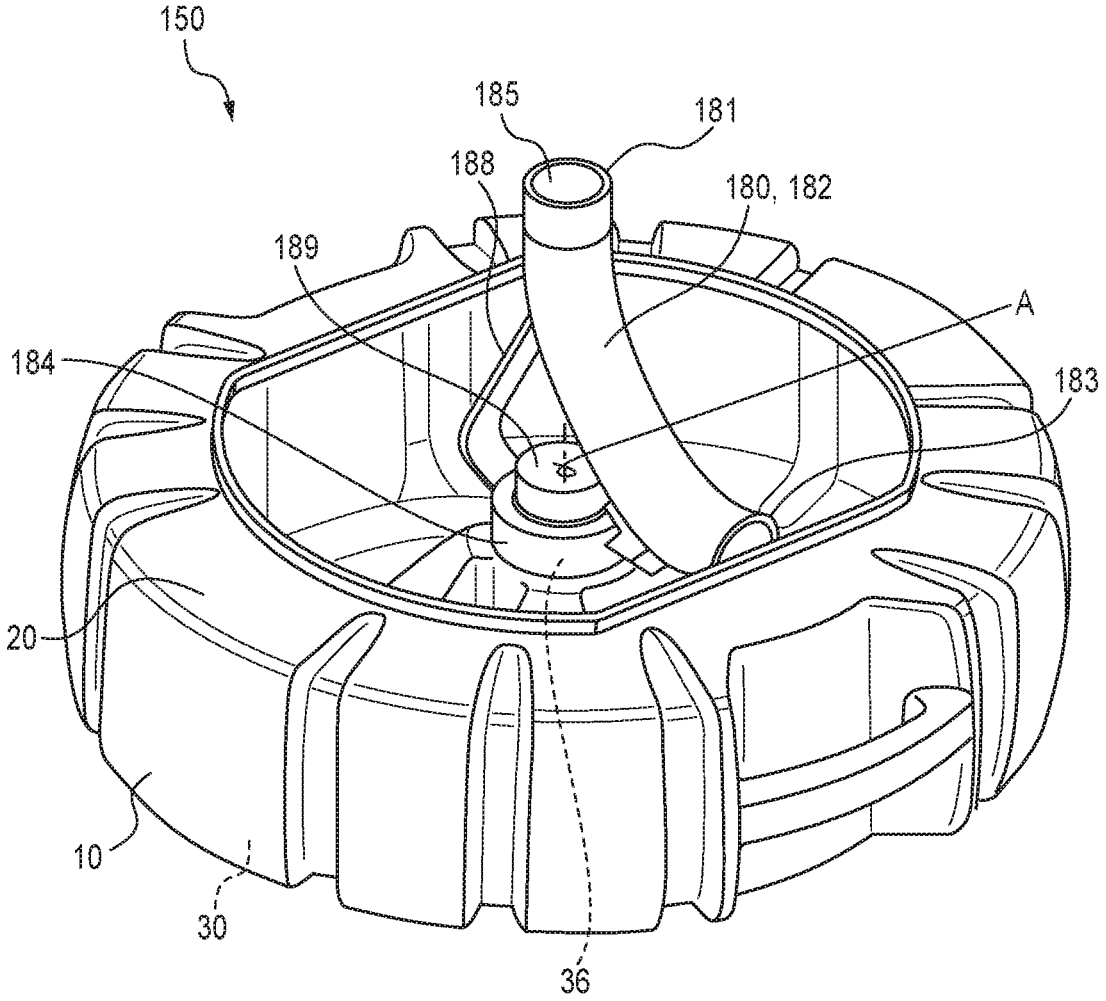
FIG. 9 illustrates another embodiment of a storage system using the drum of FIGS. 3 and 4 in accordance with the present subject matter.

Referring to FIG. 9, another storage system 150 is shown. The storage system 150 comprises the previously described storage drum 10 and a cable guide assembly 180. The system 150 is typically free of a base such as used in the previously described system 100. Instead, in use of the system 150, the drum 10 is placed directly on the floor or ground. The drum 10 is oriented such that the face 20 is directed upward and the face 30 is directed downward and at least partially contacts the floor or ground. The cable guide assembly 180 includes a cable sleeve 182 having a first elevated end 181 and a second lowered end 183. A cable passage 185 extends between the ends 181 and 183. Typically, the cable sleeve 182 extends along an arcuate axis. However, the present subject matter includes cable sleeves that extend along a linear or straight axis or a plurality of linear axes which extend at an angle to an adjacent axis. The cable guide assembly 180 also comprises provisions that enable the cable sleeve 182 to be rotated about the axis A of the cylindrical member 36 of the drum 10. In the embodiment shown in FIG. 9, the guide assembly 180 includes a base ring 184 that is rotatably positioned about the cylindrical member 36 of the drum 10. However, the present subject matter includes other configurations providing rotational movement between the cable guide assembly 180 and the drum 10. The cable sleeve 182 is secured to the base ring 184. The guide assembly 180 may additionally comprise one or more support members 188 extending between the base ring 184 and the cable sleeve 182. The guide assembly 180 may also comprise a cap or axle 189 which promotes rotational stability of the assembly 180 when rotating about axis A. The cap or axle 189 can have a variety of different forms however typically rotatably engages the member 36 of the drum 10. Preferably, the cable guide assembly 180 can be rotatably engaged with the drum 10, and disengaged from the drum 10 without the use of tools.

The present subject matter drums can be stationary mounted, or could be cart-mounted to improve mobility via a wheeled version.

Figure 10:
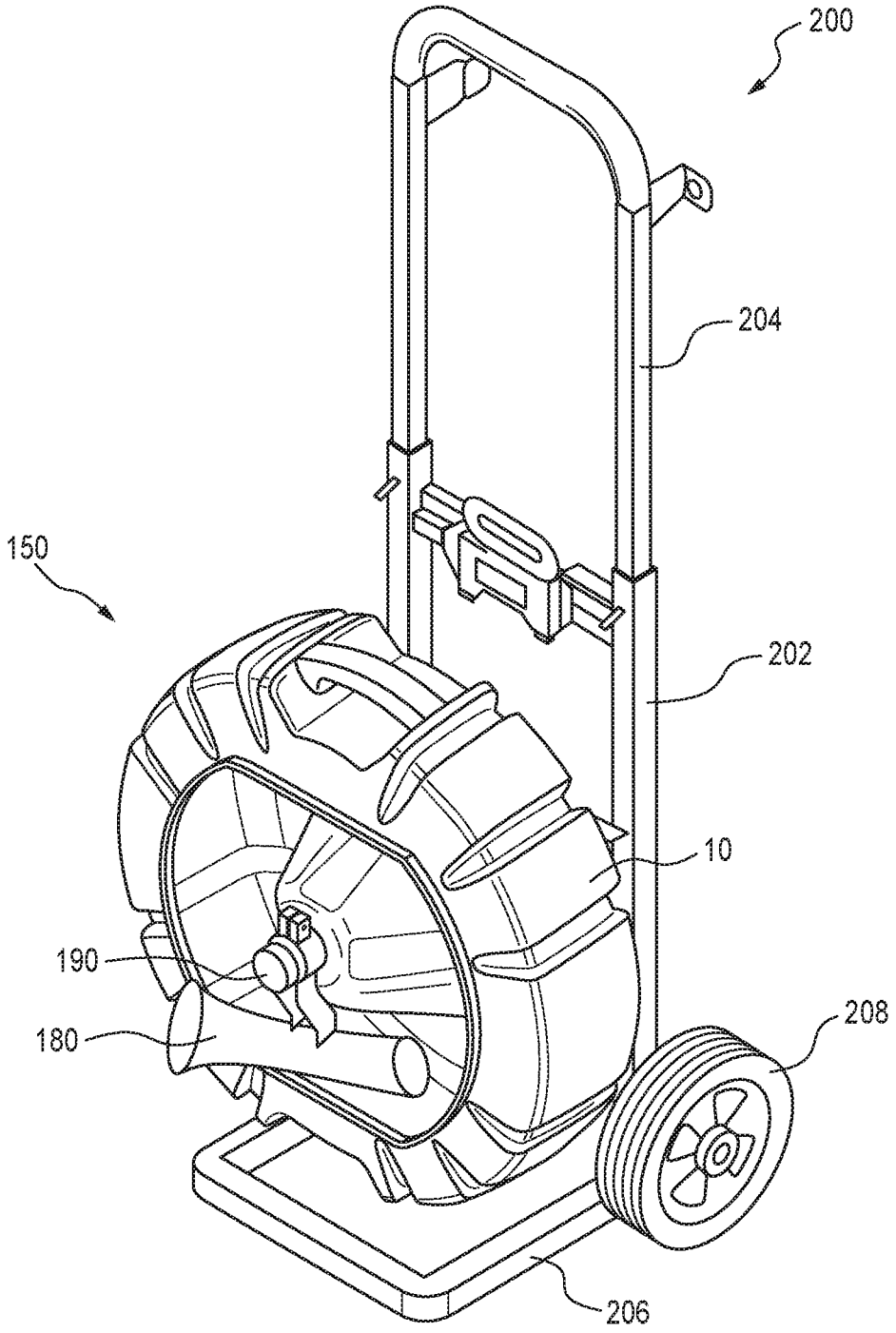
FIG. 10 illustrates use of the drum and/or storage system of FIG. 9 with a cart in association with another embodiment of the present subject matter.

FIG. 10 illustrates the storage system 150 depicted in FIG. 9, secured or supported by a mobile cart 200. In this embodiment, the cable guide assembly 180 is rotatably engaged and disengaged from a post 190 extending from the cart 200. The drum 10 is rotatable relative to the cart 200 and the cable guide assembly 180. The function and operation of the storage system 150 is the same as that of the storage system 150 shown in FIG. 9 in a non-carted version or configuration. The cart 200 typically includes a frame 202, a handle or positionable subframe 204, and a base 206. One or more wheels 208 of the cart 200 enable easy positioning and transport of the cart 200 and storage drum 10. The present subject matter also includes versions of the storage system in which the storage drum 10 is rotatably supported on the cart 200.

A significant advantage of the present subject matter is the time saved when storing drain cleaning cable or using or dispensing cable when cleaning a drain. The efficient loading and unloading of drain cable from the storage drum results in faster overall drain cleaning operation and completion of a drain cleaning job or operation.

Similarly, the easy relative rotation of the storage container to the cable guide assembly requires less overall effort to store or use sectional drain cables compared to current storage methods. This reduces the strain on the user and minimizes the work performed to prepare the jobsite or clean up after the drain blockage is cleared.

The controlled dispensing of the drain cleaning cable from the storage drum provides a predictable placement for loading and unloading the cable. Unlike conventional techniques that allow the coiled cable to spring outward from the open center of the wire basket when unloading, the present subject matter assemblies and/or systems guide the drain cable outward into a linear orientation to match the free state of the cable, thereby reducing the occurrence of unexpected cable motion.

The sectional drain cable can be removed from the storage drum and fed directly into drain cleaning equipment, minimizing the area required for operation. Using current methods, it is difficult to do this due to the tendency of the cable to rotate or expand outward from the wire basket as it is removed. Therefore, it is common for drain cleaning professionals to pull out an entire section of cable, which is typically 15 feet or longer, from the wire basket and lay the cable flat before feeding into the drain cleaning equipment for use. This additional space on the jobsite is often difficult to find. Additionally, this space is subject to potential drain fluid or debris, i.e., run-off, that may return from the drain with the cable being retrieved. By minimizing the length of cable exposed to the jobsite, the jobsite will remain cleaner.

The various drums and related assemblies and systems of the present subject matter provide a more intuitive and easy to understand method of storing or using drain cable compared to conventional approaches. Making the method of use easier helps reduce the learning curve for new users.

The enclosed cable storage container or drum provides a cleaner method of storing drain cleaning cable as it is returned from the drain. Compared to the use of currently known open wire baskets, the present methods will retain the run-off fluid and other drain debris that is retrieved with the cable within the drum for later disposal.

The additional feature of a dedicated drain and plug on the enclosed cable storage drum allows controlled draining of the fluid accumulated in the drum when the operator is in an appropriate area to clean the unit. This results in greater cleanliness and control of the system.

The further feature of integral grab handles in the drum allow easy carrying of the storage drum. Further, the round shape of the cable storage drum allows the drum to be rolled when weighted full of drain cleaning cable if the user prefers.

Likewise, the additional feature of stacking provisions reduces the footprint required to store long lengths of drain cleaning cable and improves the ability of the cable to be stored or transported.

The drain cleaning cable carrier featuring the tool-less guide assembly provides for easy change out or replacement of drums. When the contents of one drum are emptied into a drain, a new cable storage drum can be inserted quickly for continued operation. The efficiency gained by the operation of the insertion/retrieval mechanism is enhanced through continuous use with additional storage containers.

The additional feature of a wheeled cart version provides another benefit to the end user—easier transport. By providing a wheeled cart, the burden of carrying a fully weighted, heavy cable storage drum is eliminated.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A storage drum (10) for drain cleaning cables comprising:

a first face (20) radially arranged about an axis (A) and defining at least one opening (22);

an oppositely directed second face (30), wherein the second face (30) defines at least one aperture (34);

a post (96) having opposite end portions aligned with the axis (A);

a circumferential apertured or continuous outer wall (40) surrounding the axis (A) and extending between the first face (20) and the second face (30);

wherein the at least one aperture (34) is accessible from the first face (20) via the at least one opening (22); and a cable guide assembly (80), wherein the post (96) is configured to mount the cable guide assembly (80) on the post (96) when an end portion of the post (96) engages the at least one aperture (34).

2. The storage drum (10) of claim 1, wherein the second face (30) further defines a radially inwardly extending portion (32), and wherein the inwardly extending portion (32) is conical in shape and extends between the at least one aperture (34) and an outer periphery portion of the second face (30) at an angle within a range of from about 20° to about 45°.

3. The storage drum (10) of claim 1, wherein the second face (30) includes a cylindrical member (36) extending from the at least one aperture (34), wherein the cylindrical member (36) extends along an axis that is disposed perpendicular to the first face (20).

4. The storage drum (10) of claim 3, wherein the axis of the cylindrical member (36) is collinear with the axis (A).

5. The storage drum (10) of claim 1 further comprising: a selectively removable plug (50) removably disposed in an aperture formed in at least one of the first face (20) and the second face (30).

6. The storage drum (10) of claim 1 further comprising: at least one handle (60) extending radially from a portion of the circumferential outer wall (40).

7. The storage drum (10) of claim 1 further comprising: a stacking provision (70) characterized as a circular ridge extending outwardly from the second face (30).

8. The storage drum (10) of claim 7, wherein the storage drum (10) further comprises: a mating feature characterized as a raised lip (23) defined by the first face (20) and dimensioned and configured to engage the circular ridge for the purpose of securely stacking a first drum (10) atop a second drum (10), wherein the stacking provision (70) of the first drum (10), when suitably stacked atop the second drum (10), securely engages the mating feature of the second drum (10).

9. A storage system (100) for drain cleaning cables, wherein the storage system (100) comprises:

a storage drum (10) comprising:

a first face (20) radially arranged about an axis (A) and defining at least one opening (22), an oppositely directed second face (30), wherein the second face (30) defines at least one aperture (34), an elongated post (96) aligned with the axis (A), and a circumferential outer wall (40) surrounding the first axis (A) and extending between the first face (20) and the second face (30);

a base (90) including a planar member (91) defining a top face (92) and an oppositely directed bottom face (94), wherein the post (96) extends from the top face (92) of the planar member (91), wherein the drum is positioned adjacent the base (90) such that the post (96) extends at least partially through the at least one aperture (34); and a cable guide assembly (80) rotatably supported by the post (96).

10. The storage system (100) of claim 9, wherein the second face (30) further defines a radially inwardly extending portion (32), and wherein the inwardly extending portion (32) is conical in shape and extends between the at least one aperture (34) and an outer periphery portion of the second face (30) at an angle within a range of from about 20° to about 45°.

11. The storage system (100) of claim 9, wherein the second face (30) includes a cylindrical member (36) extending from the at least one aperture (34), and wherein the cylindrical member (36) extends along an axis that is disposed perpendicular to the first face (20).

12. The storage system (100) of claim 11, wherein the axis of the cylindrical member (36) is collinear with the axis (A).

13. The storage system (100) of claim 9, wherein the drum (10) further comprises: a selectively removable plug (50) that is removably disposed in an aperture formed in at least one of the first face (20) and the second face (30).

14. The storage system (100) of claim 9, wherein the drum (10) further comprises: at least one handle (60) extending radially from a portion of the circumferential outer wall (40).

15. The storage system (100) of claim 9, wherein the storage drum (10) further comprises: a stacking provision characterized as a circular ridge extending outwardly from the second face (30).

16. The storage system (100) of claim 15, wherein the storage drum (10) further comprises: a mating feature characterized as a raised lip (23) defined by the first face (20) and dimensioned and configured to engage the circular ridge for the purpose of securely stacking a first drum (10) atop a second drum (10), wherein the stacking provision (70) of the first drum (10), when suitably stacked atop the second drum (10), securely engages the mating feature of the second drum (10).

17. The storage system (100) of claim 11, wherein the cable guide assembly (80) includes a cable sleeve (82) mounted on the cylindrical member (36) or the post (96).

18. The storage system (100) of claim 9, wherein the base (90) further includes a bearing/bushing (95) mounted on the base (90) for enabling rotation of the storage drum (10) relative to the post (96) or relative to the base (90) when the base (90) is stationary.

19. A storage system (150) for drain cleaning cables, wherein the system (150) comprises:

a storage drum (10) comprising:

(i) a first face (20) radially arranged about an axis (A) and defining at least one opening (22), (ii) an oppositely directed second face (30), wherein the second face (30) defines at least one aperture (34), and (iii) a circumferential apertured or continuous outer wall (40) surrounding the axis (A) and extending between the first face (20) and the second face (30), wherein the second face (30) includes a cylindrical member (36) extending from the at least one aperture (34), wherein the cylindrical member (36) extends along an axis that is disposed perpendicular to the first face (20); and a cable guide assembly (180) rotatably supported by the cylindrical member (36), wherein the cable guide assembly (180) comprises:

a cable sleeve (182) having a first end (181) and a second end (183), and a cable passage (185) extending between the first and second ends (181 and 183), wherein the cable sleeve (182) extends along an arcuate axis.

20. The storage system (150) of claim 19, wherein the second face (30) further defines an inwardly extending portion (32) that is conical in shape and extends between the at least one aperture (34) and an outer periphery portion of the second face (30) at an angle within a range of from about 20° to about 45°.

21. The storage system (150) of claim 19, wherein the storage drum (10) further includes: a selectively removable plug (50) removably disposed in an aperture formed in at least one of the first face (20) and the second face (30).

22. The storage system (150) of claim 19, wherein the storage drum (10) further includes: at least one handle (60) extending radially from a portion of the circumferential outer wall (40).

23. The storage system (150) of claim 19, wherein the storage drum (10) further includes: a stacking provision (70) characterized as a circular ridge extending outwardly from the second face (30).

24. The storage system (150) of claim 23, wherein the storage drum (10) further includes: a mating feature characterized as a raised lip (23) defined by the first face (20) dimensioned and configured to engage the circular ridge for the purpose of securely stacking a first drum (10) atop a second drum (10), wherein the stacking provision (70) of the first drum (10), when suitably stacked atop the second drum (10), securely engages the mating feature of the second drum (10).

25. The storage system (150) of claim 19, wherein the cable guide assembly (180) includes a base ring (184) rotatably positioned about the cylindrical member (36) of the storage drum (10), and wherein the cable sleeve (182) is secured to the base ring (184).

26. The storage system (150) of claim 25, wherein the cable sleeve (182) defines a cable passage (185) that extends along an arcuate axis.

27. A storage system (150) for drain cleaning cables, wherein the storage system (150) comprises:

a mobile cart (200) comprising:

a frame (202), a base (206), and at least one wheel (208);

a storage drum (10) removably secured to the cart (200), wherein the storage drum (10) comprises:

(i) a first face (20) radially arranged about an axis (A) and defining at least one opening (22), (ii) an oppositely directed second face (30), wherein the second face (30) defines at least one aperture (34), and (iii) a circumferential apertured or continuous outer wall (40) extending between the first face (20) and the second face (30), wherein the second face (30)

defines a cylindrical member (36) extending from the at least one aperture (34), and wherein the cylindrical member (36) extends along an axis that is disposed perpendicular to the first face (20); and a cable guide assembly (180) rotatably supported by the cylindrical member (36).

28. The storage system (150) of claim 27, wherein the second face (30) further defines a radially inwardly extending portion (32), and wherein the inwardly extending portion (32) is conical in shape and extends between the at least one aperture (34) and an outer periphery portion of the second face (30) at an angle within a range of from about 20° to about 45°.

29. The storage system (150) of claim 27, wherein the storage drum (10) further includes: a selectively removable plug (50) removably disposed in an aperture formed in at least one of the first face (20) and the second face (30).

30. The storage system (150) of claim 27, wherein the storage drum (10) further includes: at least one handle (60) extending radially from a portion of the circumferential outer wall (40).

31. The storage system (150) of claim 27, wherein the storage drum (10) further includes: a stacking provision (70) characterized as a circular ridge extending outwardly from the second face (30).

32. The storage system (150) of claim 31, wherein the storage drum (10) further comprises: a mating feature characterized as a raised lip (23) defined by the first face (20) and dimensioned and configured to engage the circular ridge for the purpose of securely stacking a first drum (10) atop a second drum (10), wherein the stacking provision (70) of the first drum (10), when suitably stacked atop the second drum (10), securely engages the mating feature of the second drum (10).

33. The storage system (150) of claim 27, wherein the cable guide assembly (180) comprises: (i) a base ring (184) rotatably positioned about the cylindrical member (36) of the storage drum (10) and (ii) a cable sleeve (182) secured to the base ring (184).

34. The storage system (150) of claim 33, wherein the cable sleeve (182) defines a cable passage (185) that extends along an arcuate axis.

35. A method of storing a drain cleaning cable, wherein the method comprises:

providing a storage system (100) for drain cleaning cables, wherein the storage system (100) comprises:

a storage drum (10) defining a hollow interior and comprising:

(i) a first face (20) radially arranged about an axis (A) and defining at least one opening (22), (ii) an oppositely directed second face (30), wherein the second face (30) defines at least one aperture (34), and (iii) a circumferential apertured or continuous outer wall (40)_surrounding the axis (A) and extending between the first face (20) and the second face (30), a base (90) comprising:

a planar member (91) defining a top face (92) and an oppositely directed bottom face (94), and a post (96) extending from the top face (92) of the planar member (91), and a cable guide assembly (80) rotatably supported by the post (96), wherein the cable guide assembly (80) includes a cable passage (85);

inserting an end portion, of drain cleaning cable to be stored, through the cable passage (85) and into the hollow interior of the storage drum (10); and pushing the end portion of drain cleaning cable through the cable passage (85) and into the hollow interior of the storage drum (10) whereby at least one of the storage drum (10) and the cable guide assembly (80) rotates about the post (96), such that drain cleaning cable is formed into a coiled arrangement within the drum (10).

36. A method of selectively dispensing a drain cleaning cable from a storage drum (10), the method comprising:

providing a storage system (100) for drain cleaning cables, wherein the storage system (100) comprises:

a storage drum (10) comprising:

a first face (20) radially arranged about an axis (A) and defining at least one opening (22), an oppositely directed second face (30), wherein the second face (30) defines at least one aperture (34), an elongated post (96) aligned with the axis (A), and a circumferential outer wall (40) surrounding the axis (A) and extending between the first face (20) and the second face (30);

a base (90) including a planar member (91) defining a top face (92) and an oppositely directed bottom face (94), wherein the post (96) extends from the top face (92) of the planar member (91), and a cable guide assembly (80) rotatably supported by the post (96);

inserting an end of the drain cleaning cable to be dispensed, in the cable guide assembly (80) and out of the storage drum (10);

pulling the drain cleaning cable through the cable guide assembly (80) and out of the storage drum (10) whereby at least one of the storage drum (10) and the cable guide assembly (80) rotates about the post (96), such that the drain cleaning cable is selectively dispensed from the storage drum (10).

37. The storage drum (10) of claim 1, wherein the drum (10) defines an inner region bounded by the circumferential outer wall (40) within which inner region a coiled drain cleaning cable is disposed, wherein the cable guide assembly (80) includes a sleeve (82) that defines a cable passage (85) extending through the sleeve (82), wherein the cable passage (85) is aligned with the first axis (A) or oriented non-parallel thereto, wherein the coiled drain cleaning cable has an extendable and retractable end portion, and wherein the cable end portion, when disposed through the carriage passage (85) and extended or retracted relative to the sleeve (82), causes one of the storage drum (10) and the cable guide assembly (80) to rotate about the post (96) when the drain cleaning cable end portion is selectively extended from or retracted into the storage drum (10).

* * * * *